US007499071B2

(12) United States Patent
Nakamura et al.

(10) Patent No.: US 7,499,071 B2
(45) Date of Patent: Mar. 3, 2009

(54) EXPOSURE DEVICE WITH A TRANSMISSIVE MEMBER AND MEMBERS FOR SHIELDING THE SAME

(75) Inventors: Koichi Nakamura, Kyoto (JP); Kohichi Yamauchi, Yamatokooriyama (JP); Shinichi Takeda, Ikoma (JP); Shigenori Morimoto, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 145 days.

(21) Appl. No.: 11/457,826

(22) Filed: Jul. 17, 2006

(65) Prior Publication Data

US 2007/0020016 A1 Jan. 25, 2007

(30) Foreign Application Priority Data

Jul. 19, 2005 (JP) ..... 2005-207947

(51) Int. Cl.
*B41J 15/14* (2006.01)
*B41J 27/00* (2006.01)

(52) U.S. Cl. ..... 347/241; 347/256

(58) Field of Classification Search ..... 347/116, 347/136, 241–242, 256–257; 355/71
See application file for complete search history.

(56) References Cited

U.S. PATENT DOCUMENTS 6,674,515 B2 * 1/2004 Yamada ..... 355/71
2005/0243156 A1 * 11/2005 Matsumoto ..... 347/136

FOREIGN PATENT DOCUMENTS

JP 05019603 A * 1/1993
JP 2001-117035 4/2001
JP 2002-148910 5/2002

* cited by examiner

*Primary Examiner*—Hai C Pham
(74) *Attorney, Agent, or Firm*—Renner, Otto, Boisselle & Sklar, LLP

(57) ABSTRACT

An exposure device includes a transmissive member and a shutter. The transmissive member allows passage therethrough of a light beam directed toward a scanning object. The shutter is mounted so as to be pivotable around a pivot shaft between a closed position and an open position. The shutter has a first member and a second member. In the closed position, the first member shields the transmissive member, and, in the open position, unshields the transmissive member so as to allow the light beam to pass through the transmissive member. In the closed position, the second member is positioned above the first member so as to extend at least beyond peripheral ends, including a free end, of the first member.

5 Claims, 5 Drawing Sheets

EXPOSURE DEVICE WITH A TRANSMISSIVE MEMBER AND MEMBERS FOR SHIELDING THE SAME

CROSS REFERENCE

This Nonprovisional application claims priority under 35 U.S.C. § 119(a) on Patent Application No. 2005-207947 filed in Japan on Jul. 19, 2005, the entire contents of which are hereby incorporated by reference.

BACKGROUND OF THE INVENTION

The invention relates to an exposure device, adapted for use in an image forming apparatus, for scanning a light beam modulated according to image data across an scanning object in order to form an electrostatic latent image on the scanning object.

Electrophotographic image forming apparatus such as copiers or printers are provided with an exposure device. The exposure device scans a light beam, such as a laser beam, modulated according to image data across an scanning object, thereby forming an electrostatic latent image on the scanning object. Electrophotographic image forming apparatus use a developing device to develop the electrostatic latent image into a developer image, and uses an intermediate transfer belt to transfer the developer image on a recording medium. Thus, the apparatus forms an image on the recording medium.

Such apparatus generally use a laser-beam exposure device provided with features of high-speed laser-beam modulation, and therefore, of high-speed scanning.

Along with proliferation of color image forming apparatus in recent years, there has been a growing demand for smaller apparatus provided with higher image forming speed and improved performance in image formation with respect to various kinds of recording media such as thick paper, thin paper, or recycled paper.

This is why recent color image forming apparatus have a tandem configuration where a plurality of image forming sections are provided in alignment each of which performs an electrophotographic image forming process with respect to a corresponding, different color. An image of developer of corresponding color is formed on a scanning object provided in each image forming section. The developer image is transferred from the object to an intermediate transfer belt, and then transferred from the belt to a sheet of recording medium (hereinafter referred to merely as a "sheet"). Since developer images of different colors are first accumulated on the belt, the tandem image forming apparatus forms stable images on any kind of sheet.

In the tandem apparatus, an exposure device is positioned below the image forming sections in view of reducing the physical size, and enhancing usability, of the apparatus. The exposure device emits light beams to the scanning objects positioned above, through windows provided in a housing each including a transmissive member such as a glass plate.

The position below the image forming sections causes the transmissive members to be contaminated with dust such as developer particles fallen from the image forming sections. The contamination of the transmissive member causes improper scanning of the scanning objects. Dust is more likely to fall during a period such as when developing devices are operating in an image forming process, or when the developing devices are replaced.

A solution to the foregoing problems is a color image forming apparatus such as proposed in JP 2002-148910A. The proposed apparatus includes a shutter for shielding a transmissive member (a sealing glass), that is opened to allow a light beam for scanning a scanning object to pass through the transmissive member. At all times other than in image forming process, the shutter is closed to shield the transmissive member in order to prevent contamination thereof.

Even when the shutter is closed, however, dust becomes accumulated on and around the shutter during a period such as when developing devices are being replaced or when the apparatus is on standby.

Also, the image forming sections start or stop image forming process in the order of alignment from upstream to downstream along a direction in which the intermediate transfer belt travels. In other words, a shutter is closed in an upstream one of image forming section while a downstream image forming section is performing image forming process. Thus, dust falling from the downstream section tends to accumulate on the upstream shutter in the closed state.

When the upstream shutter is opened to unshield the transmissive member, the accumulation of dust may fall from the shutter to contaminate the transmissive member.

In light of the foregoing, a feature of the invention is to provide an exposure device that prevents contamination of a transmissive member with accumulation of dust, such as developer particles, on a shutter in the opening action of the shutter, thereby ensuring proper scanning of a scanning object.

SUMMARY OF THE INVENTION

An exposure device according to an aspect of the invention includes a transmissive member and a shutter. The transmissive member allows passage therethrough of a light beam directed toward a scanning object. The shutter is mounted so as to be pivotable around a pivot shaft between a closed position and an open position. The shutter has a first member and a second member. In the closed position, the first member shields the transmissive member, and, in the open position, unshields the transmissive member so as to allow the light beam to pass through the transmissive member. In the closed position, the second member is positioned above the first member so as to extend at least beyond peripheral ends, including a free end, of the first member.

DETAILED DESCRIPTION OF THE INVENTION

Figure 1:
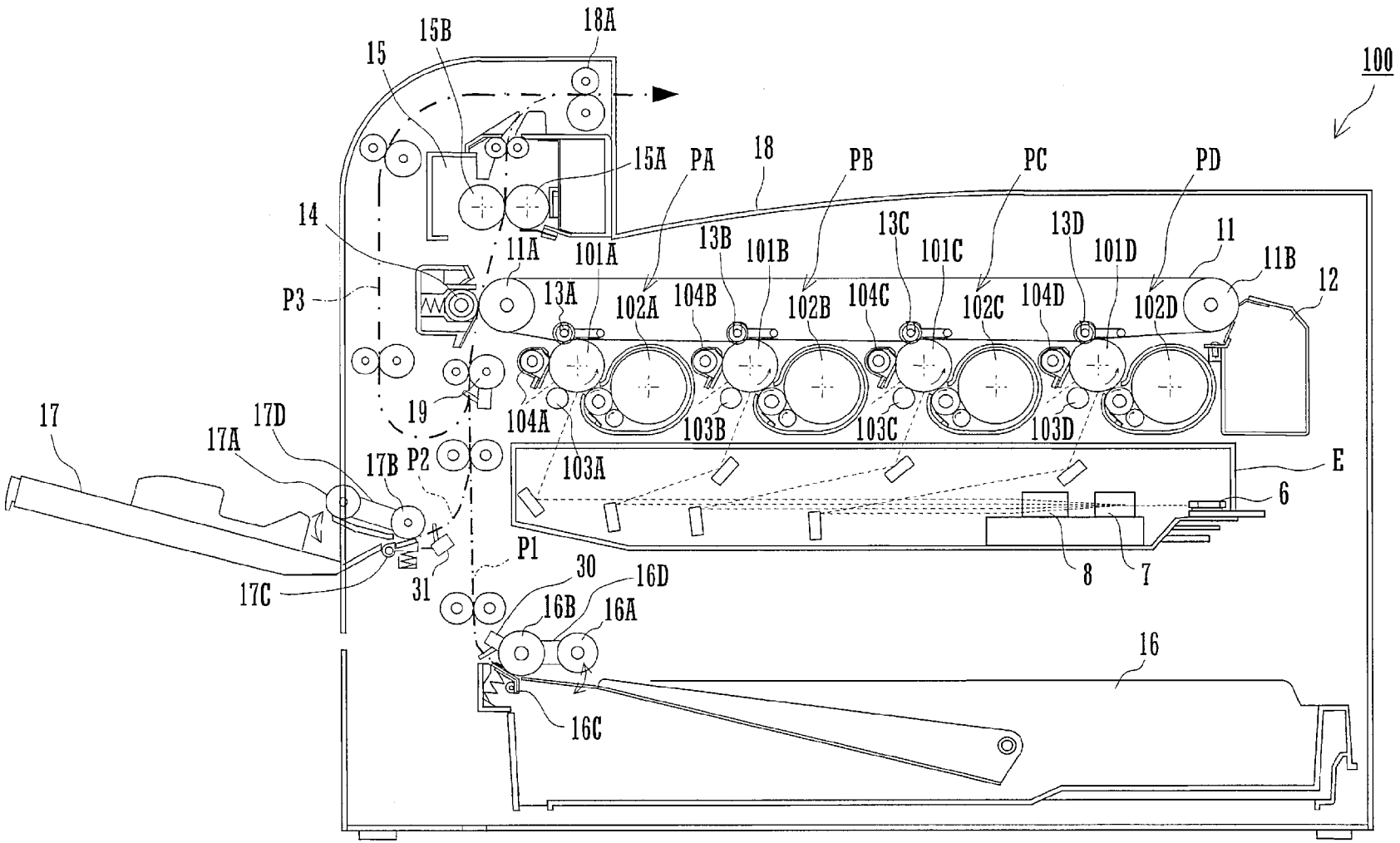
FIG. 1 is a cross-sectional view illustrating a schematic configuration of an image forming apparatus provided with an exposure device according to a first embodiment of the invention.

Several embodiments of the invention will be described below with reference to the accompanying drawings. FIG. 1 is a cross-sectional view illustrating a schematic configuration of an image forming apparatus 100 provided with an exposure device E according to a first embodiment of the invention.

The apparatus 100 forms a color or monochromatic image on a sheet of recording medium (hereinafter merely as a sheet) based on image data read from an original or on image data received though a network.

The apparatus 100 includes the exposure device E, photoreceptor drums 101A to 101D, developing devices 102A to 102D, charging rollers 103A to 103D, cleaning units 104A to 104D, an intermediate transfer belt 11, primary transfer rollers 13A to 13D, a secondary transfer roller 14, a fusing device 15, sheet transport paths P1, P2, and P3, a sheet feeding cassette 16, a manual sheet feeding tray 17, and a sheet output tray 18. Each of the drums 101A to 101D corresponds to the scanning object of the invention.

The apparatus 100 forms an image based on image data, obtained by color separation from an original image, corresponding to four colors, i.e., black (K) and the three subtractive primary colors—yellow (Y), magenta (M), and cyan (C), respectively. The image formation is performed in image forming sections PA to PD that are respectively provided for the four colors.

The sections PA to PD are similar to one another in configuration. For example, the section PA, which are devoted to black color image formation, has the photoreceptor drum 101A, the developing device 102A, the charging roller 103A, the primary transfer roller 13A, and the cleaning unit 104A. The sections PA to PD are arranged, in alignment with one another, along a direction in which the intermediate transfer belt 11 travels, i.e., along a slow scan direction perpendicular to a fast scan direction.

The rollers 103A to 103D are contact-type chargers for charging respective outer circumferential surfaces of the drums 101A to 101D uniformly so that the surfaces have a predetermined electric potential. Instead of the rollers 103A to 103D, alternatively, contact-type chargers using a charging brush, or noncontact-type charging devices, are substitutable.

The exposure device E has semiconductor lasers (not shown), a polygon mirror 6, a first fθ lens 7, and a second fθ lens 8. The device E irradiates each of the drums 101A to 101D with a laser beam modulated according to image data of a corresponding one of the four colors of black, cyan, magenta, and yellow. The laser beam corresponds to the light beam of the invention. Thus, an electrostatic latent image corresponding to the image data is formed on each of the drums 101A to 101D. The device E will be described later in detail.

The developing devices 102A to 102D store therein black, cyan, magenta, and yellow toners, respectively. The devices 102A to 102D feed the toners to the respective surfaces of the drums 101A to 101D bearing the electrostatic latent images, in order to develop the latent images into black, cyan, magenta, and yellow toner images, respectively.

The cleaning units 104A to 104D remove and collect residual toners on the respective surfaces of the drums 101A to 101D after developing and transferring operations are performed.

The intermediate transfer belt 11 is arranged as a loop between a drive roller 11A and a driven roller 11B. As the belt 11 travels, an outer circumferential surface thereof faces the drum 101D, the drum 101C, the drum 101B, and the drum 101A, in that order from upstream to downstream.

The primary transfer rollers 13A to 13D are positioned opposite the drums 101A to 101D, respectively, across the belt 11. The belt 11 faces the drums 101A to 101D in respective primary transfer areas.

To each of the rollers 13A to 13D, a primary transfer bias is applied at a constant voltage in order to transfer a toner image that each of the drums 101A to 101D bears, onto the belt 11. The primary transfer bias is opposite in polarity to the charge of the toners. Thus, the toner images for the respective colors are sequentially transferred to the outer circumferential surface of the belt 11 and superimposed on one another, so that a full-color toner image is formed on the outer circumferential surface of the belt 11.

When image data for only one or some of the four colors are input, electrostatic latent image(s) and toner image(s) are formed only on one or some of the drums 101A to 101D, depending on the input color image data. In monochromatic image formation, for example, an electrostatic latent image and a toner image are formed only on the drum 101A corresponding to the color black. Accordingly, only a black toner image is transferred to the outer circumferential surface of the belt 11.

Each of the rollers 13A to 13D has a shaft of metal such as stainless steel, and a conductive elastic material such as EPDM (Ethylene Propylene Diene Monomer) or urethane foam. The shaft is approximately 8 to 10 mm in diameter. The shaft is coated with the conductive elastic material. Through the conductive elastic material, each of the rollers 13A to 13D uniformly applies a high voltage to the belt 11.

The rotation of the belt 11 feeds a full-color or monochromatic toner image transferred thereto, to a secondary transfer area where the belt 11 faces the secondary transfer roller 14. In image formation, the roller 14 is pressed at a predetermined nip pressure against the roller 11A across the belt 11.

While a sheet fed from either the cassette 16 or the tray 17 is passing between the roller 14 and the belt 11, a high voltage opposite in polarity to the charge of the toners is applied to the roller 14. The toner image is thus transferred from the outer circumferential surface of the belt 11 to a surface of the sheet.

After the transfer operation, a cleaning unit 12 collects residual toners remaining on the belt 11 in order to prevent undesirable mixing of toners of different colors in a subsequent image forming process.

The sheet with the transferred toner image is led into the fusing device 15, and passes between a heat roller 15A and a pressure roller 15B in order to be heated and pressed. The toner image is thus firmly fixed to the surface of the sheet. The sheet with the fixed toner image is then output onto the sheet output tray 18 by sheet output rollers 18A.

The apparatus 100 has the sheet transport path PI extending approximately vertically from the cassette 16, through a gap between the roller 14 and the belt 11 and through the device 15, to the tray 18.

Along the path PI provided are a pick-up roller 16A, a sheet feeding roller 16B, a separating pad 16C, and transport rollers R. The roller 16A picks up and feeds sheets that are stored in the cassette 16, one at a time, into the path P1. If two or more sheets are picked up at a time, the pad 16C separates a top sheet from the other sheets so that only the top sheet is fed into the path PI. The rollers R transport the fed sheet along the path PI. The rollers R are rotatable at variable speeds.

Along the path P1, a sheet detector 30 is arranged immediately downstream of the 16C in a sheet transport direction. The detector 30 detects presence or absence of a sheet passing between the roller 16B and the pad 16C. More specifically, the detector 30 detects whether a sheet is properly fed into the path PI from the cassette 16 by the roller 16A. The detector 30 is connected to a control section (not shown) to output a detection result to.

Along the path P1 arranged are registration rollers 19 and the sheet output rollers 18A. The rollers 19 lead a sheet between the roller 14 and the belt 11 at a predetermined timing. The rollers 18A output a sheet onto the tray 18.

The apparatus 100 also has the sheet transport path P2 extending from the manual sheet feeding tray 17 to the rollers 19. Along the path P2 arranged are a pick-up roller 17A, a sheet feeding roller 17B, and a separating pad 17C. The roller 17A, the sheet feeding roller 17B, and the pad 17C serve to pick up and feed sheets that are stored in the tray 17, one at a time, into the path P2.

Also provided is the sheet transport path P3 extending from the rollers 18A to upstream of the registration rollers 19 on the path P1.

The rollers 18A are rotatable in forward and backward directions. In single-side image formation, and in image formation on a second side of a sheet in double-side image formation, the rollers 18A are rotated in the forward direction in order to output the sheet onto the tray 18.

In image formation on a first side of the sheet in the double-side image formation, meanwhile, the rollers 18A are first rotated in the forward direction until a tail end of the sheet passes through the device 15. Then, with the tail end nipped therebetween, the rollers 18A are rotated in the backward direction in order to feed the sheet into the path P3. Thus, in the double-side image formation, the sheet having an image formed on the first side thereof is fed into the path Fl, the tail end first, with the second side facing the side of the roller 11A.

Between the roller 14 and the belt 11, the rollers 19 feed a sheet as fed either from the cassette 16 or the tray 17, or through the path F3, in synchronized timing with the rotation of the belt 11.

At the time the drums 101A to 101D and the belt 11 are activated, the rollers 19 is in a deactivated state. Thus, any sheet that is fed or is being transported before the belt 11 is activated is stopped, with a leading end thereof held between the rollers 19. Then, when the leading end of the sheet and a leading end of the toner image formed on the belt 11 meet each other in the contact area of the roller 14 and the belt 11, the rollers 19 are activated.

In full-color image formation that involves formation of toner images in all of the sections PA to PD, the rollers 13A to 13D press the belt 11 against all of the drums 101A to 101D, respectively. In the monochromatic image formation that involves formation of toner image only in the section PA, in contrast, only the roller 13A presses the belt 11 against the drum 101A.

Figure 2:
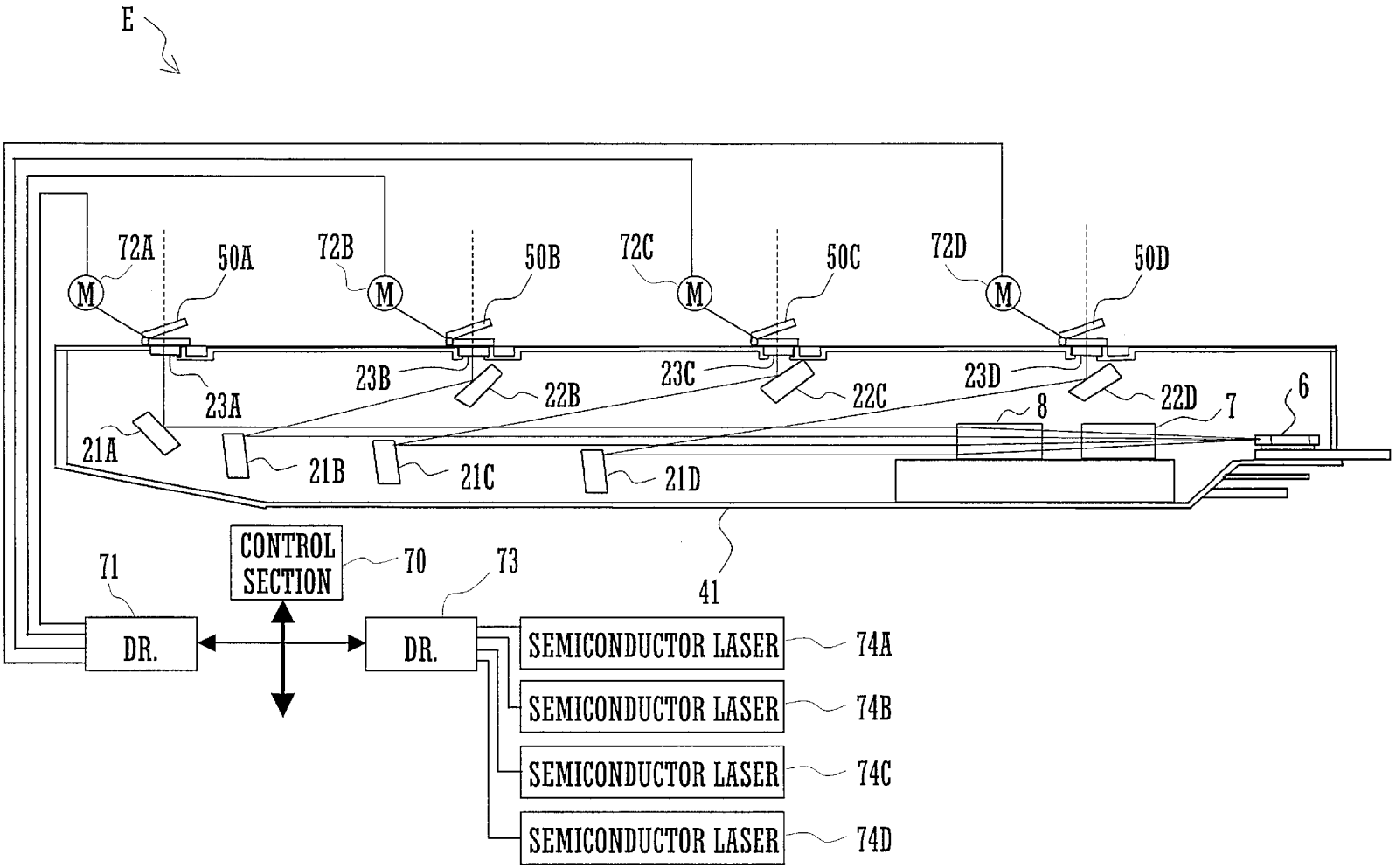
FIG. 2 is a block diagram illustrating a schematic configuration of the exposure device.

FIG. 2 is a block diagram illustrating a schematic configuration of the exposure device E. The device E has semiconductor lasers 74A to 74D, the polygon mirror 6, the first fθ lens 7, the second fθ lens 8, first reflecting mirrors 21A to 21D, second reflecting mirrors 22B to 22D, glass covers 23A to 23D, shutters 50A to 50D, and a housing 41. Each of the covers 23A to 23D corresponds to the transmissive member of the invention.

Each of the lasers 74A to 74D emits a laser beam modulated according to image data of a corresponding one of the four colors, to reflecting surfaces of the mirror 6 through a collimating lens (not shown) or the like. The mirror 6 is a rotatable mirror with several reflecting surfaces. While being rotated, the mirror 6 reflects and deflects the laser beams so that the laser beams move with constant angular speed.

The first and second fθ lenses 7 and 8 collectively deflect the laser beams so that the laser beams move with constant speed. The lens 8 also renders the laser beams parallel to the slow scanning direction.

The first reflecting mirrors 21A to 21D and the second reflecting mirrors 22B to 22D reflect the laser beams to the drums 101A to 101D, respectively, through a cylindrical lens (not shown) and through the glass covers 23A to 23D.

The covers 23A to 23D serve as windows that allow the respective laser beams directed toward the drums 101A to 101D from the inside of the housing 41 to pass therethrough.

Each of the shutters 50A to 50D is pivotable between a closed position and an open position. In the closed positions, the shutters 50A to 50D shield the covers 23A to 23D, respectively. In the open positions, the shutters 50A to 50D unshield the covers 23A to 23D, respectively, so as to allow the light beams to pass through the covers 23A to 23D.

The shutters 50A to 50D are located in the closed positions during a period when the laser beams are not being emitted to the drums 101A to 101D, respectively.

The shutters 50A to 50D are pivoted to the open positions when the laser beams are to be emitted to the drums 101A to 101D, respectively. The shutters 50A to 50D are pivoted back to the closed positions when emission of the laser beams is terminated.

When the apparatus 100 is to print a full-color image, for example, the image forming sections PD, PC, PB, and PA start respective image forming processes in the order, i.e., in the order of alignment from upstream to downstream along the direction in which the belt 11 travels. The shutters 50D, 50C, 50B, and 50A start to be pivoted in the order to the open positions or the closed positions in accordance with a timing when the sections PD to PA start or stop the image forming processes.

The exposure device E also has a control section 70. The section 70 activates the lasers 74A to 74D, through a driver 73, to emit the laser beams. Also, the section 70 activates motors 72A to 72D, through a driver 71, to pivot the shutters 50A to 50D, respectively, from the open positions to the closed positions, and vice versa, in accordance with a timing when emission of the laser beams is started or terminated. Further, the section 70 has overall control over operation of the apparatus 100.

Figure 3A:
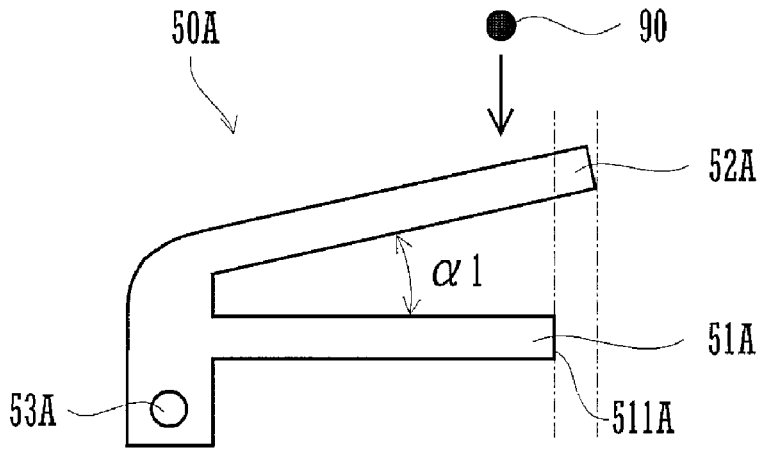
FIG. 3A is an enlarged view of a shutter in a closed position.
Figure 3B:
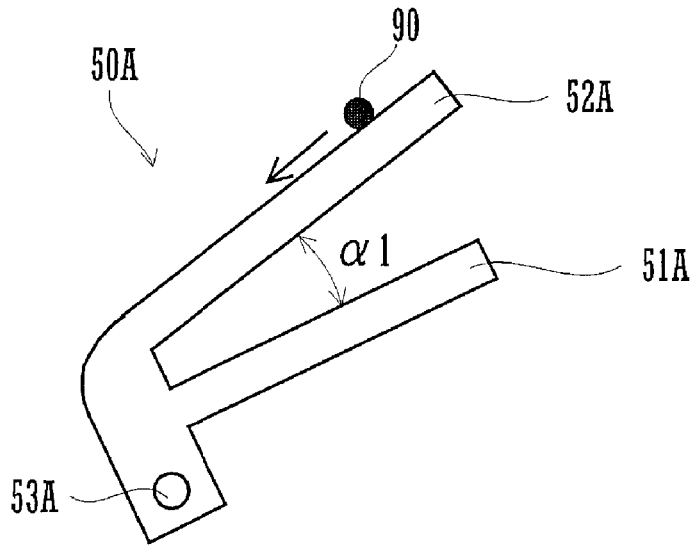
FIG. 3B is an enlarged view of the shutter in an open position.

FIG. 3A is an enlarged view of the shutter 50A in the closed position. FIG. 3B is an enlarged view of the shutter 50A in the open position. The shutters 50B to 50D are similar in configuration to the shutter 50A.

The shutter 50A has a first member 51A and a second member 52A.

In the closed position, the member 51A shields the cover 23A, and, in the open position, unshields the cover 23A.

In the closed position, the member 52A is positioned above the member 51A so as to extend beyond peripheral ends, including a free end 511A, of the member 51A so as to cover the entire member 51A. The member 52A is inclined down toward a pivot shaft 53A. The member 52A is provided for preventing contamination of an upper surface of the member 51A.

The pivot shaft 53A is provided at an end, opposite to the free end 511A, of the shutter 50A.

The member 51A and the member 52A are integrally molded so as to be pivoted together around the shaft 53A with an angle α1 maintained therebetween.

With the shutter 50A in the closed position, as described above, the member 52A is positioned above the member 51A, so that the member 52A receives dust 90 fallen onto the shutter 50A, thereby preventing accumulation of the dust 90 on the member 51A. Thus, the member 52A prevents the dust 90 from falling onto the cover 23A when the shutter 50A is pivoted to the open position. Accordingly, the member 52A prevents contamination of the cover 23A, thereby allowing the drum 101A to be properly scanned by the laser beam.

When the member 51A is pivoted upward, moreover, the member 52A is also pivoted upward and thus becomes more steeply sloped, so that accumulation of dust 90 on the member 52A, if any, is removed without falling onto the member 51A. This configuration prevents the dust 90 from falling on the cover 23A when the shutter 50A is pivoted to the open position.

Further, the integral molding of the members 51A and 52A allows a low-cost, simplified configuration of the shutter 50A.

Since the member 52A extends beyond the member 51A to cover the entire member 51A, this configuration is particularly effective in preventing the dust 90 from falling on the member 51A. This configuration is thus effective in preventing the dust 90 from falling on the cover 23A when the shutter 50A is pivoted to the open position.

Moreover, the member 52A is effective in preventing dust 90 that originates from any of the other drums 101B to 101D and accumulates on the member 52A, from accumulating on the member 51A. This configuration is thus effective in preventing the dust 90 from falling on the cover 23A when the shutter 50A is pivoted to the open position.

Since the shutters 50B to 50D are similar in configuration to the shutter 50A as described above, the configuration of the first embodiment also prevents contamination of the covers 23B to 23D, thereby allowing the drums 101B to 101D to be properly scanned by the laser beams.

Figure 4A:
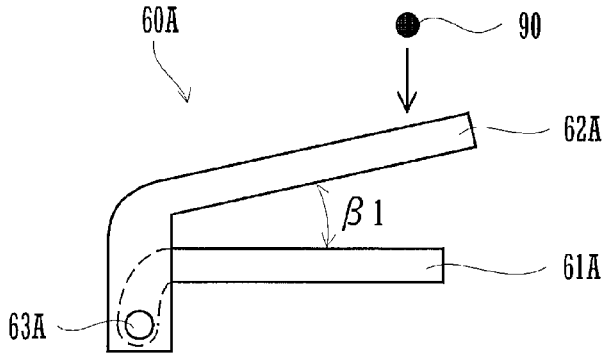
FIG. 4A is an enlarged view of a shutter, in a closed position, provided in an exposure device according to a second embodiment of the invention.
Figure 4B:
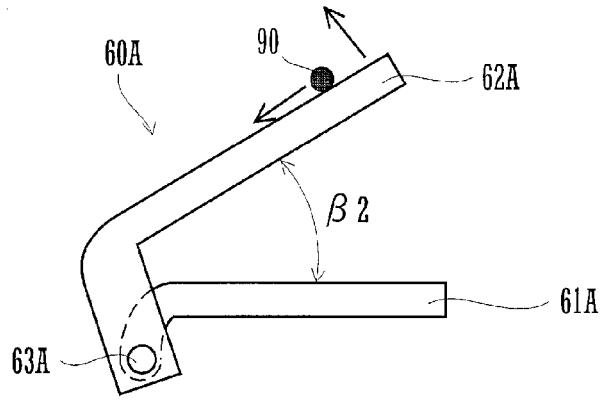
FIG. 4B is an enlarged view of the shutter with only a second member pivoted.
Figure 4C:
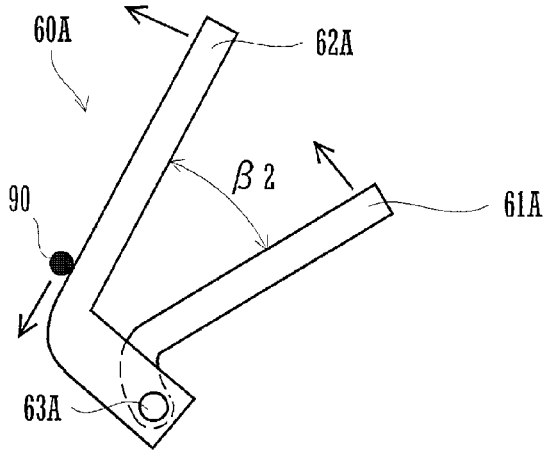
FIG. 4C is an enlarged view of the shutter in an open position.
Figure 5A:
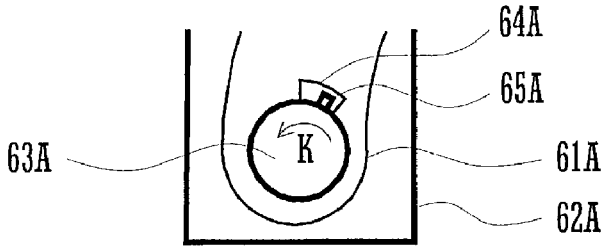
FIGS. 5A to 5C are partial enlarged views of the shutter.
Figure 5B:
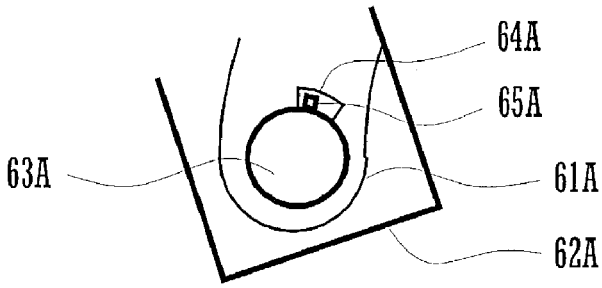
Figure 5C:
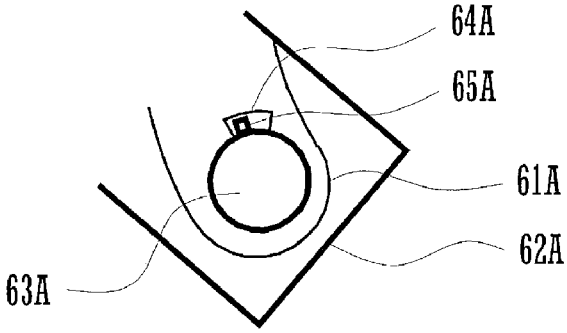

FIG. 4A is an enlarged view of a shutter 60A, in a closed position, provided in an exposure device E2 according to a second embodiment of the invention. FIG. 4B is an enlarged view of the shutter 60A with only a second member 62A pivoted. FIG. 4C is an enlarged view of the shutter 60A in an open position. FIGS. 5A to 5C are partial enlarged views of the shutter 60A. Although not shown in the figure, there are also provided shutters 60B to 60D that are similar in configuration to the shutter 60A.

The shutter 60A has a first member 61A and a second member 62A.

In the closed position, the member 61A shields the glass cover 23A, and, in the open position, unshields the cover 23A.

In the closed position, the member 62A is positioned above the member 61A so as to extend beyond peripheral ends, excluding a pivot end, of the member 61A so as to cover the entire member 61A. The member 62A is provided for preventing contamination of an upper surface of the member 61A.

When the shutter 60A is pivoted from the closed position to the open position in the second embodiment, the member 62A is pivoted through a larger angle than an angle through which the member 61A is pivoted. In the pivoting movement of the shutter 60A, more specifically, only the member 62A is first pivoted upward, as shown in FIG. 4B, until an angle between the members 61A and 62A is increased from β1 to β2. Then, as shown in FIG. 4C, the members 61A and 62A are pivoted together with the angle β2 maintained therebetween.

The members 61A and 62A are pivoted around a shared pivot shaft 63A. In the second embodiment, the shaft 63A is fixed to the member 62A and thus rotated together with the member 62A. As shown in FIG. 5A, the member 61A has a hole in which the shaft 63A is to be installed. The hole has a groove 64A. The shaft 63A has a projection 65A to be placed in the groove 64A.

When the shutter 60A is pivoted from the closed position to the open position, the shaft 63A is rotated in a direction of arrow K. With the shutter 60A in the closed position, the projection 65A is positioned at an upstream end of the groove 64A in the direction K.

In a former stage thereof, the rotation of the shaft 63A in the direction K is not transmitted to the member 61A since the projection 65A is moved within the groove 64A. Thus, only the member 62A is pivoted.

When the shaft 63A is rotated through a predetermined angle, the projection 65A is brought against a downstream end of the groove 64A. In a latter stage, thus, the rotation of the shaft 63A is transmitted to the member 61A, thereby allowing the members 61A and 62A to be pivoted together.

When the shutter 60A is pivoted from the closed position to the open position, according to the second embodiment, the member 62A is pivoted through a wider angle than an angle through which the member 61A is pivoted. Thus, accumulation of dust 90 on the member 62A can be efficiently removed. Accordingly, the configuration of the second embodiment is more efficient in preventing a fall of dust 90 on the cover 23A when the shutter 60A is pivoted to the open position, thereby allowing the drum 101A to be properly scanned by the laser beam.

As described earlier, the shutters 60B to 60D are similar in configuration to the shutter 60A. Thus, the configuration of the second embodiment also prevents contamination of the covers 23B to 23D with dust 90, thereby allowing the drums 101B to 101D to be properly scanned by the laser beams.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exposure device, comprising:

a transmissive member for allowing passage therethrough of a light beam directed toward a scanning object; and a shutter mounted so as to be pivotable around a pivot shaft between a closed position and an open position, the shutter including:

a first member for shielding the transmissive member in the closed position and for unshielding the transmissive member in the open position so as to allow the light beam to pass through the transmissive member; and a second member being positioned over the first member so as to extend at least beyond peripheral ends, including a free end, of the first member, in the closed position, and in the closed position, the second member is inclined down toward the pivot shaft.

2. The exposure device according to claim 1, wherein the second member is mounted so as to be pivoted upward at least when the first member is pivoted upward.

3. The exposure device according to claim 2, wherein the first and second members are integrally molded so as to be pivoted together with a predetermined angle maintained therebetween.

4. The exposure device according to claim 1, further comprising a control section configured to pivot the shutter to the open position in accordance with a timing when the light beam is to be passed through the transmissive member, and to pivot the shutter back to the closed position after the light beam is passed through the transmissive member.

5. An exposure device, comprising:

a transmissive member for allowing passage therethrough of a light beam directed toward a scanning object; and a shutter mounted so as to be pivotable around a pivot shaft between a closed position and an open position, the shutter including:

a first member for shielding the transmissive member in the closed position and for unshielding the transmissive member in the open position so as to allow the light beam to pass through the transmissive member; and a second member being positioned over the first member so as to extend at least beyond peripheral ends, including a free end, of the first member, in the closed position, wherein the second member is mounted so as to be pivoted upward at least when the first member is pivoted upward, and further comprising a pivot angle adjusting mechanism for allowing the second member to be pivoted through a larger angle than an angle through which the first member is pivoted when the shutter is pivoted from the closed position to the open position.

* * * * *